US011851317B2

(12) United States Patent
Rardin

(10) Patent No.: US 11,851,317 B2
(45) Date of Patent: Dec. 26, 2023

(54) SYSTEM AND METHOD FOR EASY CATCH COLLAR

(71) Applicant: Danette Rardin, Beaver Creek, OR (US)

(72) Inventor: Danette Rardin, Beaver Creek, OR (US)

( * ) Notice: Subject to any disclaimer, the term of this patent is extended or adjusted under 35 U.S.C. 154(b) by 0 days.

(21) Appl. No.: 17/993,816

(22) Filed: Nov. 23, 2022

(65) Prior Publication Data

US 2023/0091968 A1 Mar. 23, 2023

Related U.S. Application Data

(63) Continuation of application No. 17/361,000, filed on Jun. 28, 2021, now abandoned.

(51) Int. Cl.
*B68B 3/04* (2006.01)

(52) U.S. Cl.
CPC ..... *B68B 3/04* (2013.01)

(58) Field of Classification Search
None
See application file for complete search history.

(56) References Cited

U.S. PATENT DOCUMENTS 3,949,538 A * 4/1976 Woodruff ..... B68B 1/02 54/24
4,777,784 A * 10/1988 Ferguson ..... A01K 27/005 57/225
7,705,736 B1 * 4/2010 Kedziora ..... A01K 27/009 340/573.3
2008/0008731 A1 * 1/2008 Hurwitz ..... A01K 27/007 424/409
2015/0040839 A1 * 2/2015 Goetzl ..... A01K 15/021 119/720
2015/0259189 A1 * 9/2015 Gipson ..... B68B 1/02 54/24
2017/0290302 A1 * 10/2017 Waters ..... A44B 11/125
2018/0229999 A1 * 8/2018 Bjarle ..... B68B 7/00
2019/0216056 A1 * 7/2019 Lown ..... A01K 27/003
2019/0350169 A1 * 11/2019 Weinrauch ..... A01K 11/008
2022/0330526 A1 * 10/2022 Lee ..... A01K 27/005

FOREIGN PATENT DOCUMENTS

FR 2949041 A3 * 2/2011 ..... A01K 27/005

OTHER PUBLICATIONS

"Can't Catch Your Horse? Solve it with Connection Training!" by Connection Training. Apr. 14, 2016. <https://www.youtube.com/watch?v=-7UA1qmGQxQ> (Year: 2016).*

(Continued)

*Primary Examiner* — Magdalena Topolski
*Assistant Examiner* — Morgan T Jordan
(74) *Attorney, Agent, or Firm* — Bold IP, PLLC; Christopher Mayle

(57) ABSTRACT

A method for placing a collar around the neck of a horse or other livestock discreetly whereby the horse will not notice the collar as the user approaches. The collar may be squeezed and hidden in the hand of the user as the user approaches the horse. The collar may then be stretched over the horses neck. The collar is made up of a loop that is elastic flexible material connected by a clamp.

4 Claims, 4 Drawing Sheets

(56) References Cited

OTHER PUBLICATIONS

"Lifetime Collar," Atlas Pet Company. Jun. 1, 2020. <https://atlaspetcompany.com/products/lifetime-collar> (Year: 2020).*
New Tech Pneumatic Press for Grommets, Snaps, Buttons & Rivets w/Laser Pointer. GoldStar Tool (Year: 2021).*
No Buckle Stretch Belt for Women and Men Elastic Waist Belt up to 72 Inches for Jeans Pants, Amazon, Jan. 2, 2018 (Year: 2018).*

* cited by examiner

SYSTEM AND METHOD FOR EASY CATCH COLLAR

CROSS REFERENCE TO RELATED APPLICATIONS

This application is a continuation which claims priority to U.S. Non-Provisional application Ser. No. 17/361,000 filed on Jun. 28, 2021 which claims priority to U.S. Provisional Application No. 63/045,050 filed on Jun. 20, 2020.

FIELD OF DISCLOSURE

The field of disclosure is generally directed to collars and more particularly an elastic catch collar designed to be placed around a horse without the need for tying or hooking up the collar to a lead rope.

BACKGROUND

Conventionally, a lead rope may be used to catch and lead a horse. The lead rope is connected to a halter, rope halter, cavesson, or neck ring. Lead ropes are not left attached to the horse's halter when a user is riding and need to be removed. Different lead ropes are also needed to offer varying degrees of hold. Lead ropes and halters can be cumbersome and hard to put on with multiple tying techniques required. The lead rope and halter also warn the horse that the horse is trying to be caught. Thus exists a need for an easy to use catch collar that may be used discreetly.

SUMMARY

The present invention is directed to a method of catching a horse, comprising approaching the horse, stretching a collar, positioning the collar over a neck of the horse, attaching a clamp on the collar to a first arm and a second arm of a band forming a loop, attaching the clamp to the band with high pneumatic pressure, selecting a specific color for the collar to provide identification information about the horse or provide a calming effect to the horse, coloring the band and the clamp with pigmented dye, and cutting the band wherein the band is made of flat rubber bungee.

The present invention is also directed to a method of positioning a collar over a neck of the horse, the collar having a band and a clamp, the band made entirely of an elastic flexible material with a first arm and a second arm attached at to the clamp, keeping the collar in place on the neck of the horse while riding the horse, selecting a specific color collar to provide identification information about the horse, coloring the band and the clamp with pigmented dye, cutting the band at 33 inches wherein the band is made from a ½ inch flat rubber bungee, and attaching the clamp with high pneumatic pressure.

The present invention is also directed to a horse catch collar comprising a band and a clamp, the band having a first arm and a second arm attached at to the clamp, wherein the band is made of an elastic flexible material, wherein the band is made from ½ inch flat rubber bungee, wherein the band is cut at 33 inches, wherein the clamp is a stainless steel sleeve, wherein the clamp is ½ inch, wherein the band is a first color and the clamp is a second color to provide identification information about a horse.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION

Figure 1:
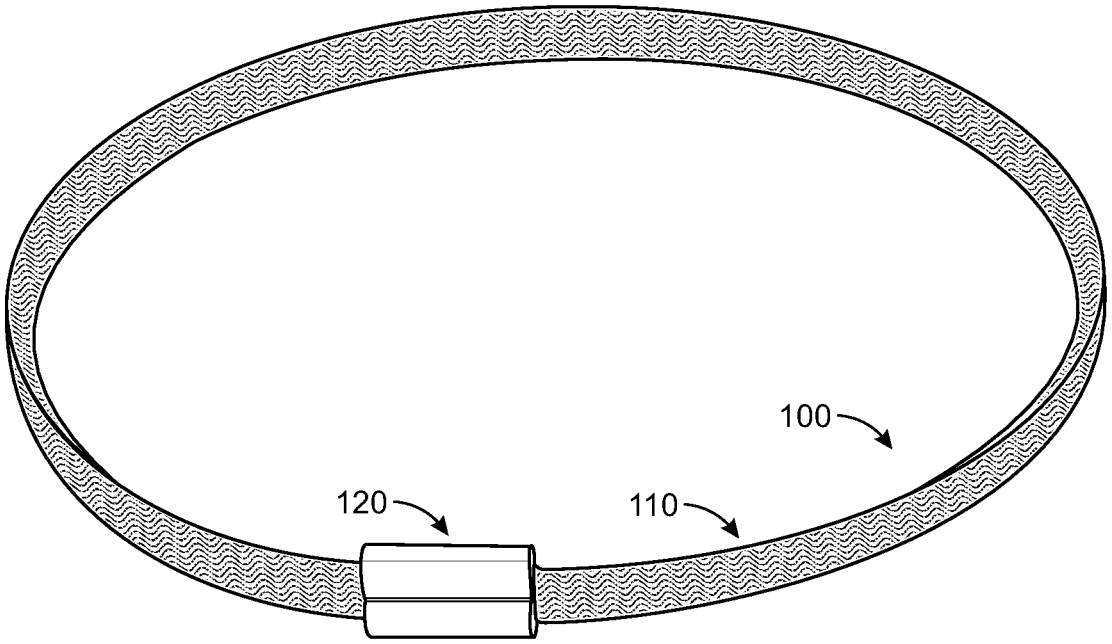
FIG. 1 is an illustration of a front perspective view of a first and second embodiment of an easy catch collar accordance with the present invention.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The present disclosure is generally directed to a system and method of use, according to one or more exemplary embodiments, for an easy catch collar designed to be placed around the neck of a horse or another livestock discreetly whereby the horse will not notice the collar as the user approaches with the collar in hand as because of the elastic flexible material the collar may be squeezed or bunched up and hidden in the hand of the user as the user approaches the horse.

Figure 2:
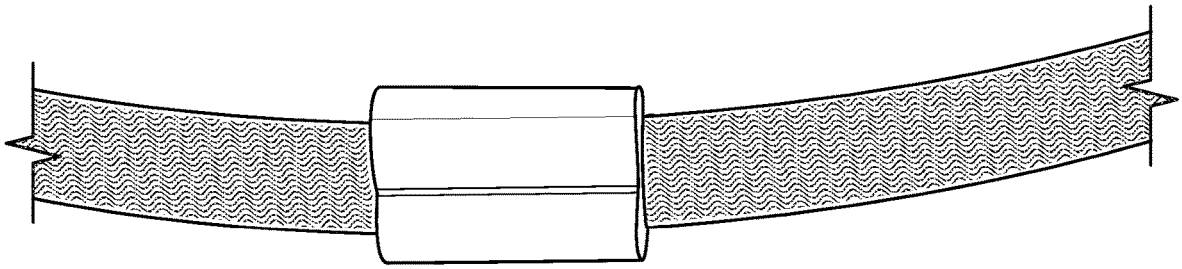
FIG. 2 is an illustration of a front perspective view of the clamp of the first embodiment.
Figure 3:
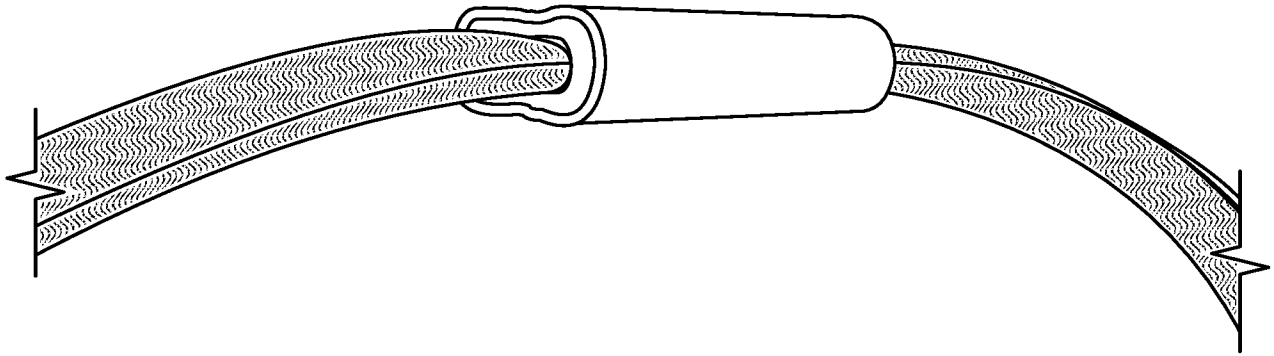
FIG. 3 is another illustration of a top perspective view of the clamp of the first embodiment.

With reference now to FIG. 1-3, a first and second exemplary embodiment of a catch collar 100 is shown. Band 110 is flat and made of an elastic flexible material with a first arm and a second arm attached to a clamp 120. Band 110 may have an antimicrobial layer or multiple layers whereby a first layer has a porous substrate and a second layer positioned beneath the first layer is material to disperse moisture away from the first layer. The first arm and the second arm have their ends enclosed within clamp 120 such that a loop is formed. The elastic cord in one embodiment is a ½ inch flat rubber bungee cut at 33 inches. The clamp is a ½ inch stainless steel sleeve whereby the first end and second ends of band 110 may be fastened to each other by the clamp which tightened by pneumatic pressure. However, this is non-limiting and the first end and second end of band 110 may be connected or fastened by any method known by those of ordinary skill in the art such as but not limited to screws, Velcro®, pressure or snap fit, clips, buckles, nuts and bolts, latches, hinges, or any other type of fasteners. Clamp 120 is designed to be permanent but in some embodiments, clamp 120 may be removable.

Band 110 and clamp 120 may be a specific color (blue, brown, orange, red, green, etc.) to identify particular horse or family of horses and hence provide identification information about the horse including using different colors to identify different factors such as age, type, and owner. In other non-limiting embodiments, a label 149, as illustrated in FIG. 2, may be shrink wrapped around clamp 120 or fastened around clamp by any number of hinges, latches, adhesive, or other fasteners whereby label 149 has one or more apertures to allow passage of band 110 while protecting clamp 120 outside elements. Label may have any number of lettering or decal information. Although shown as encompassing the entire band 110 and clamp 120, it is to be understood that the color may be confined to only a portion of band 110 and/or clamp 120 in accordance with other embodiments. In further embodiments a locator chip may be positioned between clamp and label 149.

Figure 4:
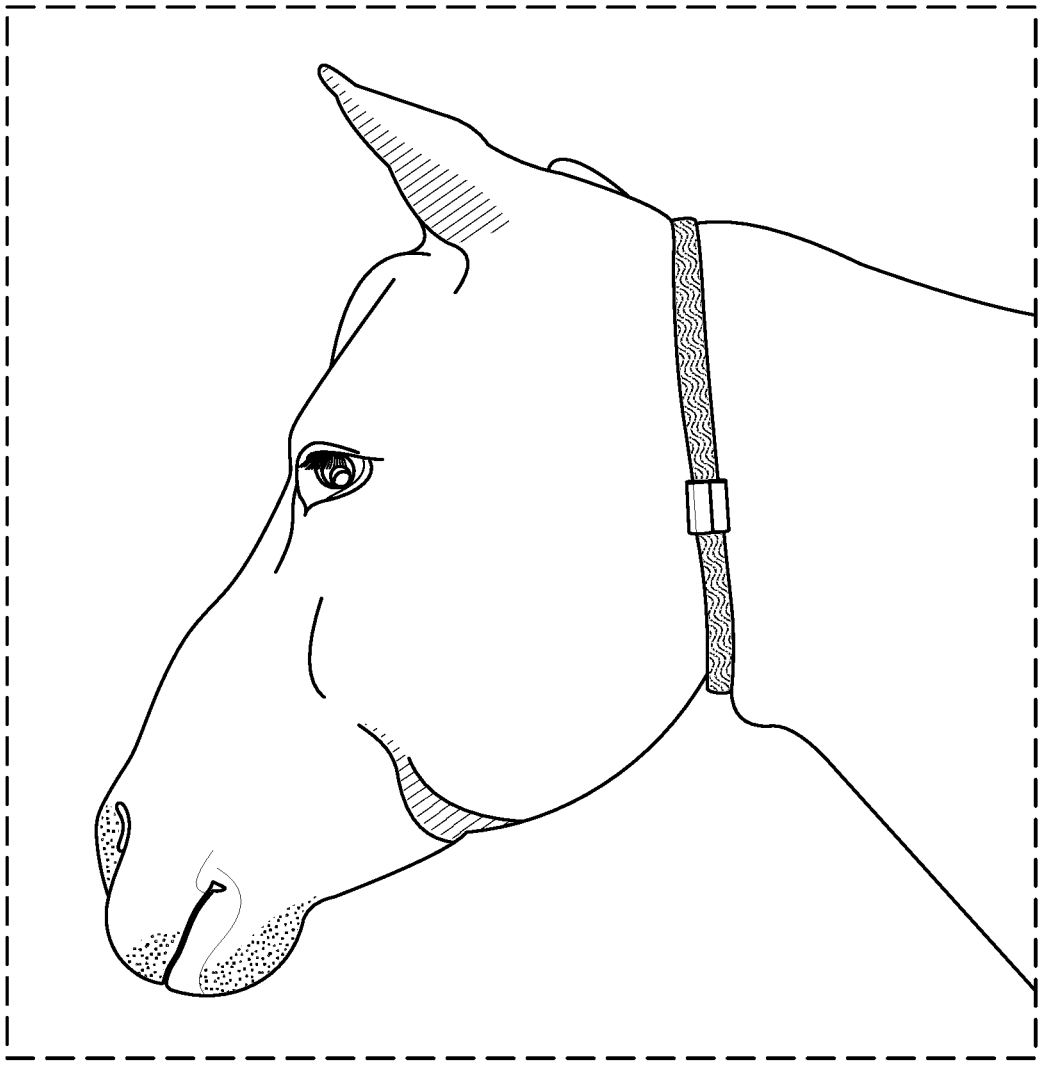
FIG. 4 is an illustration of the second embodiment in use on a horse.

The color may be applied to band 110 and clamp 120 in a variety of manners. For example, the color may be a pigmented dye positioned onto band 110 and clamp 120 during the manufacturing process. Band 110 and clamp 120 may also have different patterns as shown in FIG. 4. In other embodiments there may be a different color or pattern on each side to signify a current occurrence or mood with the horse.

In use, collar 100 may be held discreetly in a user's hand whereby the user approaches a horse 200 with collar 100 as because of the elastic flexible material the collar may be squeezed or bunched up and hidden in the hand of the user as the user approaches the horse. Once in near proximity to horse 200, the user may stretch band 120 over horse's 200 neck whereby once over the neck the user may release the collar 100 the user may release collar 100 whereby collar 100 is secured in place over horse 200 with no need to fasten any additional elements, as illustrated in FIG. 4. When collar 100 is in position over horse's 200 neck, the user may stretch band 110 to lead the horse. Collar 100 may remain on horse 200 throughout the entire process as well as when the user is riding on horse 200.

The foregoing description of the invention has been presented for purposes of illustration and description and is not intended to be exhaustive or to limit the invention to the precise form disclosed. Many modifications and variations are possible in light of the above teaching. The embodiments were chosen and described to best explain the principles of the invention and its practical application to thereby enable others skilled in the art to best use the invention in various embodiments and with various modifications suited to the use contemplated.

The invention claimed is:

1. A method of catching a horse, consisting of the following steps in order:

squeezing or compressing a collar such that the collar is hidden in a hand;

approaching the horse with the collar in the hand such that the collar is not visible from outside the hand to the horse whilst approaching, wherein the collar is a permanent closed loop made of a band and a clamp, the band made entirely of an elastic flexible material with an end of a first arm and an end of a second arm enclosed in the clamp by pneumatic pressure;

uncovering the collar from the hand when near the horse;

stretching the collar over a neck of the horse;

releasing the collar, wherein after releasing the collar is secured in place over the horse;

keeping the collar in place on the neck of the horse while riding the horse; and locating the horse by a positioned locator chip positioned between a shrink wrapped label and the clamp.

2. The method of claim 1 further consisting of:

selecting a specific color of the collar to provide identification information about the horse; and selecting a specific pattern of the collar to provide the identification information about the horse.

3. The method of claim 1 further consisting of:

providing the band with a length of 84 cm (33 inches) wherein the band is made from a flat rubber bungee.

4. A method of catching a horse, consisting of the following steps in order:

squeezing a collar such that the collar is entirely hidden in a hand;

approaching the horse with the collar in the hand such that the collar is not visible from outside the hand to the horse whilst approaching to the horse, wherein the collar is a single permanent closed loop made of a band and a clamp, the band made entirely of an elastic flexible material with an end of a first arm and an end of a second arm fastened to each other by the clamp;

uncovering the collar from the hand when in proximity to the horse;

stretching the collar over a neck of the horse;

releasing the collar, wherein after releasing the collar is secured in place over the horse;

keeping the collar in place on the neck of the horse while riding the horse;

stretching the collar to lead the horse; and locating the horse by a positioned locator chip positioned between a shrink wrapped label and the clamp.

* * * * *